United States Patent [19]

Leifeld et al.

[11] 4,240,182

[45] Dec. 23, 1980

[54] ARRANGEMENT FOR OPENING TEXTILE FIBER BALES

[75] Inventors: Ferdinand Leifeld, Kempen; Jürgen Marx, Monchen-Gladbach, both of Fed. Rep. of Germany

[73] Assignee: Trutzschler GmbH & Co. KG, Monchen-Gladbach, Fed. Rep. of Germany

[21] Appl. No.: 22,270

[22] Filed: Mar. 20, 1979

[30] Foreign Application Priority Data

May 2, 1978 [DE] Fed. Rep. of Germany ..... 2819292

[51] Int. Cl.[3] ..... D01G 7/06

[52] U.S. Cl. ..... 19/81; 19/145.5; 241/101 A

[58] Field of Search ..... 19/80 R, 80 A, 81, 82, 19/83, 85, 86, 97.5, 105, 145.5, 239, 240, 241; 241/101 A

[56] References Cited

U.S. PATENT DOCUMENTS

| | | | |
|---|---|---|---|
| 3,360,831 | 1/1968 | Morikawa et al. | 19/145.5 X |
| 3,797,072 | 3/1974 | Goldammer | 19/81 |
| 3,900,920 | 8/1975 | Whitehurst | 19/81 |
| 4,000,541 | 1/1977 | Marzoli | 19/81 |

FOREIGN PATENT DOCUMENTS

| | | | |
|---|---|---|---|
| 4316911 | 7/1971 | Japan | 19/80 R |
| 287553 | 1/1971 | U.S.S.R. | 19/80 R |

*Primary Examiner*—Louis Rimrodt

*Attorney, Agent, or Firm*—Haseltine, Lake & Waters

[57] ABSTRACT

An arrangement for opening textile fiber bales, particularly hard-pressed cotton bales. The fiber material is removed from above and moved by layers in the horizontal plane of the layer, and delivered to an opening element to break up the layer into fiber flakes. The entire fiber material of the uppermost layer may be moved towards the opening element. The arrangement has at least one conveying roller for moving the layer, and an opening roller cooperating with it. The apparatus may have two or more counterrotating conveying rollers above which the opening roller is located. The conveying rollers may rotate in the same direction and the opening roller may be horizontally adjacent. The peripheral speeds of the conveying rollers increase with the proximity to the opening roller. The conveying rollers may have toothed rings on the surface, and the toothed rings of successive rollers engage one another. A holding roller may be located between the opening roller and the conveying roller next to it. A carding element or a deflector element may be located in the same area. The speeds of conveying rollers and opening rollers may be continuously variable.

21 Claims, 7 Drawing Figures

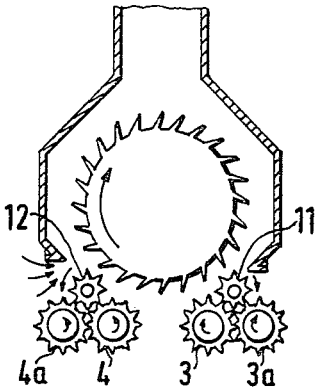
FIG. 3
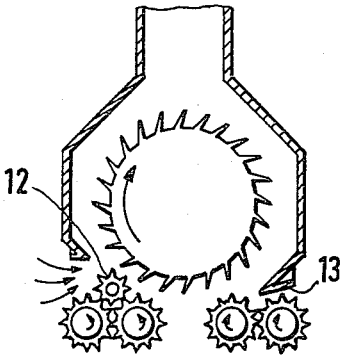
FIG. 4
FIG. 6
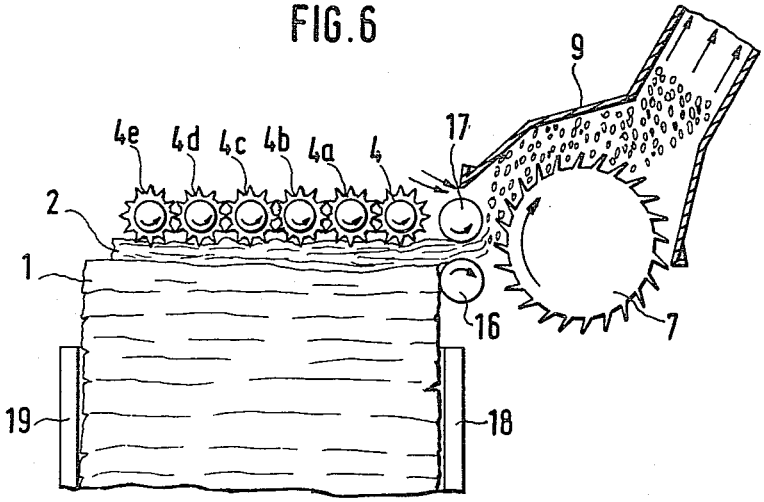

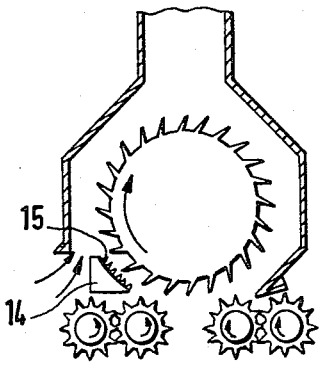
FIG.5
FIG.7
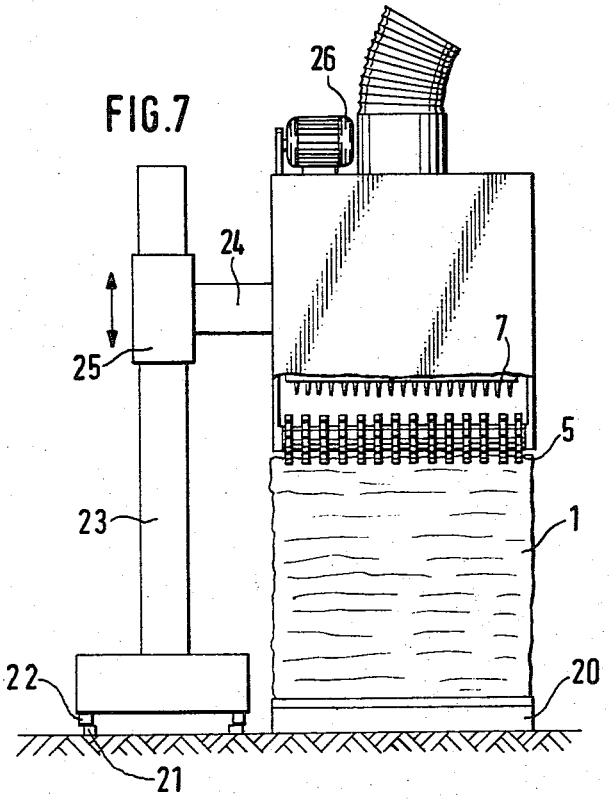

ARRANGEMENT FOR OPENING TEXTILE FIBER BALES

BACKGROUND OF THE INVENTION

The present invention relates to a method for opening textile fiber bales, particularly hard-pressed cotton bales, where the fiber material of one or several bales is removed from above, and efficient apparatus for carrying out the method.

In a method known in the art, a fiber bale is pressed from below against an opening roller. The latter directly removes fiber from the bale, depending on the compactness of the bales, in varying quantities. Ordinarly the fiber bales have no uniform compactness. However, when in this known method fiber bales delivered successively to the opening roller have varying compactness, the opening device plucking with constant effect removes a varying amount of fiber. With fiber bales of less compactness there is even the danger that entire layers or at least large lumps are removed from the fiber bales. To avoid these shortcomings, the removed fiber material is to be delivered to a sensing element by which the feeding speed of the fiber bale is to be adjusted. This method has the disadvantage that a uniform fiber removal from the bale and a uniform breakup into fine flakes cannot be achieved. For one, a certain time interval passes until the removed quantity is measured via the sensing element and then the feed speed of the fiber bale is changed. Also, a changed feed speed cannot prevent the tearing out of chunks of different size as a result of the direct interference of the opening roller. Another annoying feature is that the arrangement for carrying out this method with a sensing element, a driven platform for the fiber bale and separate switching devices for varying the transport speed are much too expensive.

Accordingly, it is an object of the present invention to provide a method of the above type which permits a uniform removal of layers from a fiber bale and which allows the uniform breakup of layers into fine fiber flakes.

Another object of the present invention is to provide an arrangement of the foregoing character which is substantially simple in construction and may be economically fabricated.

A further object of the present invention is to provide an arrangement, as described, which may be readily maintained in service and which has a substantially long operating life.

SUMMARY OF THE INVENTION

The present invention is based on the concept of breaking up the fiber bales into fine flakes in two successive steps. First, the uppermost layer (with pressed bales) or stratum (with unpressed bales) is moved, preferably pulled, in the plane of the layer or stratum, i.e., essentially horizontally towards the opening element. This layer or stratum is grasped by the opening element and dissolved into fine fiber flakes. Hence, the opening element does not directly enter into the fiber bales, as with the known method, but breaks up the layers or strata continusouly delivered to it. It is essential that the two steps follow each other immediately, i.e., that layers or strata are moved, delivered to the opening element and broken up continuously and simultaneously. It has been found by experience that these method steps in accordance with the present invention act in combination so that the uniform, controlled removal of the uppermost layer or stratum of each fiber bale and the immediately following breakup of these layers or strata in a short time interval produces a uniform quantity of small fiber flakes. The detachment of the flakes from the layer or stratum proceeds with great gentleness because the thickness of the layer or stratum is reduced and thus limited by a clamping location, and because the layer or stratum is moved essentially radially towards the opening element so that the fiber flakes are pulled from the layer or stratum.

Preferably, the entire fiber material of the uppermost layer or stratum is moved towards the opening element, so that the uppermost surface is fully affected. Hence the opening element exclusively grasps and breaks up only that fiber material which is moved in its plane, i.e., is pulled from the fiber bale and transported towards the opening element. Preferably the entire fiber material of the uppermost layer or stratum is moved towards the opening element.

The invention also includes an expedient apparatus for carrying out the method, providing at least one conveying roller as pressure roller for moving the layers and a breakdown roller acting jointly with it. The conveying roller is pressed against the fiber bale and has the task of producing a moveable layer or stratum and also of moving it.

During rotation of the conveying roller, the layer or stratum is pulled off the fiber bale and is transported in an essentially horizontal direction. The layer or stratum is clamped between the conveying roller, which is under pressure, and the base of the moved layer or stratum. The conveying rollers may be pinned rollers or star-wheel rollers. As opening roller, a pinned roller is sued. It is expedient to have the conveying roller engage the pinned roller so that the conveying roller is cleaned thereby. The pinned roller may rotate at about 560 rpm.

In a preferred embodiment, two conveying rollers rotate in opposite directions; the opening roller is arranged above them. The conveying rollers move to the uppermost layer or stratum towards its center. As a result, this layer or stratum bulges in the space between the two conveying rollers away from the fiber bale towards the opening roller. Only the uppermost region of this bulge is engaged by the preferably fast-moving opening roller; as a result, no lumps are detached from the bale, only small flakes are detached from the layer or stratum. With large material accumulations between the conveying rollers closest to the opening roller, they also jam in the horizontal direction. This embodiment has the additional advantage that no shear forces act from the outside on the fiber bale so that the fiber bale cannot topple over. Another embodiment provides at least two conveying rollers rotating in the same direction, with the opening roller being placed adjacently. In this embodiment, the fiber bale is held and supported from the side. During the pressing of a conveying roller against the bale topside, the layers or strata can bluge in their end region and topple over toward the conveying roller. This leads to a rolling motion of the layer in the pull-in region of the conveying roller. This is avoided when at least two conveying rollers are provided. When using several conveying rollers, a special advantage results from making the peripheral speed of the conveying rollers increase towards the opening roller. This results in a type of delay, i.e., a build-up is prevented if the conveying rollers closest to the opening roller pull with the greatest speed on the layer or stratum. Furthermore, the layer or stratum undergoes a preliminary breakup and becomes thinner, leading to finer flakes. The conveying rollers expediently have toothed rings on the surface to permit effective engagement of the layer or stratum and hence facilitate movement. This gives the surface of the conveying rollers a particularly good grip. When the toothed rings of successive conveying rollers engage each other, surplus fiber material sticking to one conveying roller can be combed out by the engaging roller; thus the conveying rollers clean each other. In the region between the opening roller and the conveying roller closest to it, another roller may be expediently provided as auxiliary or holding roller which returns material forced off the opening roller back onto the opening roller. This roller also may engage its adjacent conveying rollers. Instead of this roller, a sheet metal deflector may be provided. In the region between the opening roller and the conveying roller next to it, there may be a carding element, consisting of a base plate and a mounting located towards the opening rollers. Preferably the speeds of the conveying rollers and/or of the opening roller can be varied continously to make possible adaptation of the device to different fiber types and degrees of compactness of the fiber bales and to influence the amount of moved layers or strata, or fiber flakes produced. When the arrangement in accordance with the present invention is applied from the above to the fiber bales, the same contact pressure of the conveying rollers on the fiber bales prevails, regardless of the weight of the fiber bale. This is determined by the inherent weight of the arrangement. Since the contact pressure influences the produced flake quantity, the contact pressure can be varied directly or indirectly, for example by additional weight or pneumatically. According to a particularly preferred embodiment, the breakup roller is connected to a flake suction device. For this purpose, the opening roller is enclosed by a housing which is connected via an opening to a suction fan. Such a device ensures quick removal of the flakes, combined with a trouble-free delivery to the next machine, for example, a cleaner, by pipelines. Furthermore, such a device prevents entry of a dust-laden air into the work area. If the air supply entry is between the lower end of the suction device and the conveying rollers, there also is a beneficial cleaning effect on the conveying rollers. The arrangement in accordance with the present invention is expediently fastened to a traveling device, i.e., moveable along successive fiber bales. Also the height of the arrangement is adjustable.

The novel features which are considered as characteristic for the invention as set forth in particular in the appended claims. The invention itself, however, both as to its constructions and its method of operation, together with additional objects and advantages thereof, will be best understood from the following description of specific embodiments when read in connection with the accompanying drawings.

BRIEF DESCRIPTION OF THE DRAWING

FIG. 3 shows an arrangement with two auxiliary and holding rollers;

FIG. 4 shows an arrangement with an auxiliary and holding roller and one sheet metal deflector;

FIG. 5 shows an arrangement with a carding element;

FIG. 6 shows an arrangement with six conveying rollers all rotating in the same direction; and FIG. 7 shows an arrangement with a travel carriage and height adjustment device.

DESCRIPTION OF THE PREFERRED EMBODIMENTS

Figure 1:
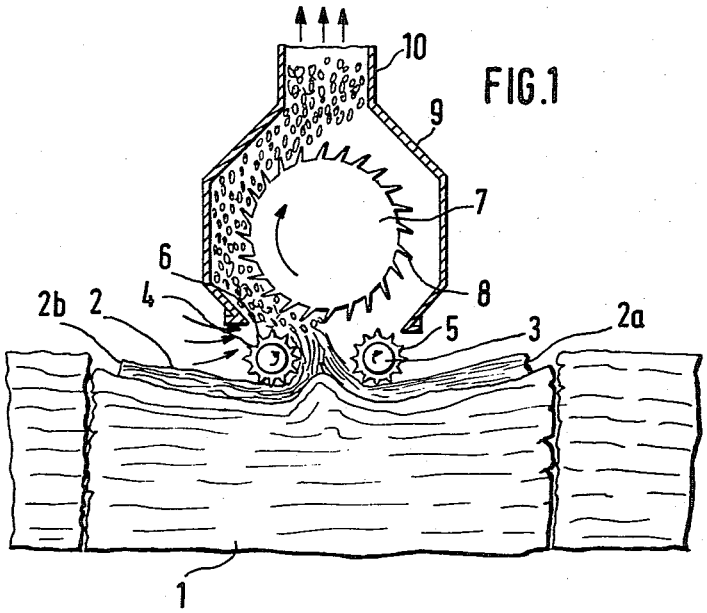
FIG. 1 shows a side view of an arrangement in accordance with the present invention with two counterrotating conveying rollers.

FIG. 1 shows a row of textile fiber bales 1 sitting on a pallet (not shown); these bales are pressed in layers 2 of which only the uppermost layer 2 of the middle bale 1 is shown. Above the layer 2 are two conveying rollers 3, 4 of which the conveying roller 3 rotates clockwise and the conveying roller 4 rotates counterclockwise. The conveying rollers 3, 4 are equipped with toothed rings 5, 6. The direction of motion of layer 2 is established such that the two portions **2*a*, 2*b* move towards each other. The peak peripheral speed of conveying rollers 3, 4 is about 0.5–5 meters/minute. Above the space between the two conveying rollers 3, 4 is a pinned roller with pins 8 as opening roller 7; these pins are inclined in the direction of rotation. This pinned roller has a diameter of 360 mm (including needles of 450 mm) and is set in counterclockwise rotation by a drive (not shown) at about 800 rpm (about 1130 meters/min). The pinned roller is enclosed by a housing 9 which is connected via a connection 10 to a suction fan (not shown). The air supply for this flake suction device 9, 10 enters between the conveying roller 5 and the lower end of housing 9**.

Figure 2:
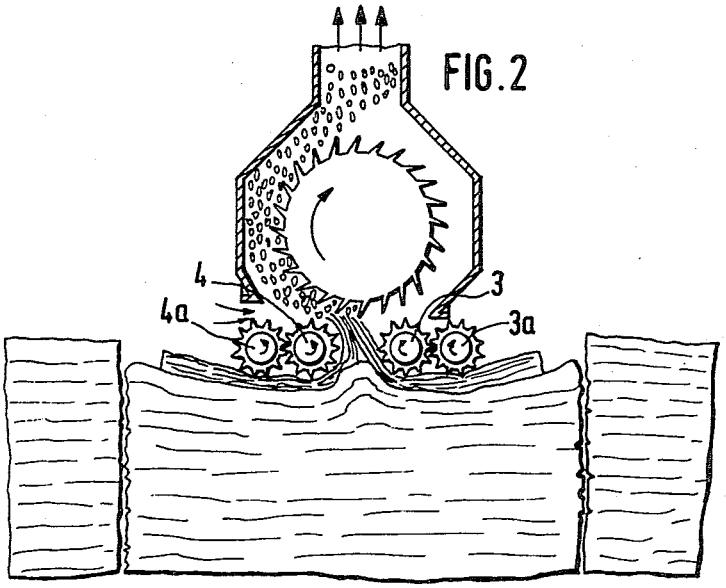
FIG. 2 shows an arrangement according to FIG. 1, but with four conveying rollers.

According to FIG. 2, an additional conveying rollers **3*a*, 4*a* is located behind each of conveying rollers 3, 4. While the conveying rollers 3, 4 move the layer at about 1 meter/minute, the conveying rollers 3*a*, 4*a* convey at about 0.8 meters/minute. The conveying rollers 3, 3*a* rotate clockwise, the conveying rollers 4, 4*a* rotate counterclockwise. The toothed rings (indicated by circles) of conveying rollers 3 and 4 engage the gaps between the toothed rings of conveying rollers 3*a* and 4*a*** behind them.

According to FIG. 3, above the conveying roller **3, 3*a* on one side, and conveying rollers 4, 4*a* on the other side, there is an auxiliary and holding roller 11, 12. The toothed rings (indicated by circles) of these auxiliary and holding rollers 11, 12 engage the gaps between the toothed rings of the associated conveying rollers 3, 3*a* and 4, 4*a*. Instead of auxiliary and holding roller 11, a sheet metal deflector 13 may be provided as shown in FIG. 4. Also, one or both auxiliary and holding rollers 11, 12 may be replaced by a carding element 14** with mounting.

FIG. 6 shows an embodiment with six conveying rollers 4 to **4*e* rotating in the same direction; these rollers transport the uppermost layer 2 of fiber bale 1 towards two clamping rollers 16, 17. The opening roller 7 is arranged next to the fiber bale 1 in approximately the same plane with the conveying rollers 4 to 4*e* and the clamping rollers 16, 17. Housing 9 of the flake suction device is located above the opening roller 7. The fiber bale 1 is held on the sides by vertical bale support walls 18, 19**.

According to FIG. 7, the fiber bales 1 (only one is shown) are placed on a pallet 20 on the floor of the spinning room. On the floor adjacent to the pallet 20 are rails 21 on which a vertical structure 23 can travel along the row of bales. The holding structure 23 has a horizontal holding arm 24 attached via a fastening member 25 with a height adjustment. The holding arm 24, to whose free end the arrangement in accordance with the invetnion is fastened, extends transversely over the entire surface of the textile fiber bale 1. The arrangement in accordance with the present invention rests on top of this bale. A motor 26 drives (in a manner not shown) the opening roller 7 and the conveying rollers 5.

During operation, the arrangement in accordance with the present invention is lowered onto a fiber bale 1 till it rests with a given weight (for example, its own weight) on the fiber bale 1. The conveying rollers 3, 4 take hold of the uppermost layer 2 and transport this layer 2 towards the opening roller 7 (see FIG. 1). The ends of portions *2a, 2b* of layer 2 are bent upwards toward the opening roller 7. This bent-up region of layer 2 is directed radially toward opening roller 7 which is located above the conveying rollers 3, 4 and with its pins 8 grasps only the top region of the bent-up layer 2. The fine flakes detached from layer 2 are sucked in the direction of rotation between the opening roller 7 and the housing 9 by the opening in connection 10).

The opening process may be both time and quantity controlled; this means that, after passage of a certain time interval or after reaching a certain amount of flakes, the arrangement is lifted from the processed fiber bale 1, moved to one of the adjacent fiber bales and lowered onto this fiber bale 1 for processing. In this manner a programmed removal of flakes can be realized, i.e., a predetermined amount of fine fiber flakes can be produced in a given mixture ratio for further processing, for example, in a cleaner.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for opening textile fiber bales, particulary hard-pressed cotton bales, comprising the steps of: removing fiber material from above; transporting fiber material by layers in the plane of the layer; delivering fiber material to an opening element for breaking up into fiber flake.

2. A method as defined in claim 1 including the step of transporting all fiber material of the uppermost layer towards said opening element.

3. A method as defined in claim 1 wherein said bales are held stationary while said opening element moves vertically, together with said conveying roller and said opening roller, said layers being first separated from the surface of the bales of fiber by the conveyor roller and transported to said opening element, said opening element being positioned at an interval above said opening roller and the bale, said opening element processing the layers that have been separated and fed to it into fiber flakes, the uppermost layers of the bale being not grasped directly by said opening element while said layers are still on the bale, said opening element grasping the layers only when the layers have been separated from the bale and delivered to said opening element.

4. An apparatus for opening textile fiber bales, particularly hard-pressed cotton bales, comprising: means for removing fiber material from above; means for transporting fiber material by layers in the plane of the layer; means for delivering fiber material to an opening element for breaking up into fiber flakes; at least one conveying roller as pressure roller for moving a layer; and an opening roller cooperating with said conveying roller.

5. An apparatus as defined in claim 4 comprising: at least two counterrotating conveying rollers, said opening roller being located above said conveying rollers.

6. An apparatus as defined in claim 4 wherein said conveying rollers have peripheral speeds increasing towards said opening roller.

7. An apparatus as defined as claim 4 including toothed rings located on the surface of said conveying rollers.

8. An apparatus as defined in claim 7 wherein said toothed rings of successive conveying rollers engage one another.

9. An apparatus as defined in claim 8 including a holding roller in a region between said opening roller and an immediately adjacent conveying roller.

10. An apparatus as defined in claim 9 including a carding element in a region between said opening roller and an immediately adjacent conveying roller.

11. An apparatus as defined in claim 10 including a deflector element in a region between said opening roller and an immediately adjacent conveying roller.

12. An apparatus as defined in claim 4 comprisng at least two conveying rollers rotating in the same direction and being located horizontally adjacent to said opening roller.

13. An apparatus as defined in claim 4 wherein speeds of said conveying rollers and of said opening roller are continuously variable.

14. An apparatus as defined in claim 4 wherein contact pressure of said conveying rollers against a surface of a fiber bale is adjustable.

15. An apparatus as defined in claim 14 wherein adjustment of said contact pressure is by supplementary weight.

16. An apparatus as defined in claim 14 wherein adjustment of said contact pressure is by pneumatic means.

17. An apparatus as defined in claim 4 including a flake suction means connected to said opening roller.

18. An apparatus as defined in claim 17 including air intake means located between a lower end of said flake suction means and said conveying rollers.

19. An apparatus as defined in claim 4 including travel means for traveling along the fiber bales, said travel means being moveable by a height-adjustment means in a vertical direction along the fiber bales.

20. An apparatus as defined in claim 4 wherein said bales are held stationary while said opening element moves vertically, together with said conveying roller and said opening roller, said layers being first separated from the surface of the bales of fiber by the conveyor roller and transported to said opening element, said opening element being positioned at an interval above said opening roller and the bale, said opening element processing the layers that have been separated and fed to it into fiber flakes, the uppermost layers of the bale being not grasped directly by said opening element while said layers are still on the bale, said opening element grasping the layers only when the layers have been separated from the bale and delivered to said opening element.

21. An apparatus as defined in claim 4 including at least two counterrotating conveying rollers, said opening roller being located above said conveying rollers, said conveying rollers having peripheral speeds increasing towards said opening roller, toothed rings located on the surface of said conveying rollers, said toothed rings of successive conveying rollers engaging one another, a holding roller in a region between said opening roller and an immediately adjacent conveying roller, a carding element in a region between said opening roller and an immediately adjacent conveying roller, a deflector element in a region between said opening roller and an immediately adjacent conveying roller, speeds of said conveying rollers and of said opening roller being continuously variable, contact pressure of said conveying rollers against a surface of a fiber bale being adjustable, adjustment of said contact pressure being by supplementary weight, flake suction means connected to said opening roller, air intake means located between a lower end of said flake suction means and said conveying rollers, travel means for travelling along the fiber bales, said travel means being movable by a height-adjustment means in a vertical direction along the fiber bales, said bales being held stationary while said opening element moves vertically, together with said conveying roller and said opening roller, said layers being first separated from the surface of the bales of fiber by the conveyor roller and transported to said opening element, said opening element being positioned at an interval above said opening roller and the bale, said opening element processing the layers that have been separated and fed to it into fiber flakes, the uppermost layers of the bale being not grasped directly by said opening element while said layers are still on the bale, said opening element grasping the layers only when the layers have been separated from the bale and delivered to said opening element.

* * * * *